US011434788B2

(12) United States Patent
Tada et al.

(10) Patent No.: US 11,434,788 B2
(45) Date of Patent: Sep. 6, 2022

(54) VALVE TIMING ADJUSTING DEVICE

(71) Applicant: DENSO CORPORATION, Kariya (JP)

(72) Inventors: Kenji Tada, Kariya (JP); Hiroki Takahashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/521,251

(22) Filed: Nov. 8, 2021

(65) Prior Publication Data

US 2022/0056820 A1 Feb. 24, 2022

Related U.S. Application Data

(63) Continuation of application No. PCT/JP2020/019425, filed on May 15, 2020.

(30) Foreign Application Priority Data

May 21, 2019 (JP) ..... JP2019-095014

(51) Int. Cl.

| | |
|---|---|
| ***F01L 1/352*** | (2006.01) |
| ***F01L 1/053*** | (2006.01) |
| *F01L 1/344* | (2006.01) |
| *F01L 13/00* | (2006.01) |
| *F01L 1/30* | (2006.01) |

(52) U.S. Cl.

CPC ..... *F01L 1/352* (2013.01); *F01L 1/053* (2013.01); *F01L 1/30* (2013.01); *F01L 2001/0537* (2013.01); *F01L 2001/34493* (2013.01); *F01L 2001/34496* (2013.01); *F01L 2013/103* (2013.01); *F01L 2820/032* (2013.01)

(58) Field of Classification Search

CPC ..... F01L 1/053; F01L 2001/0537; F01L 1/30; F01L 2001/34493; F01L 2001/34496; F01L 1/352; F01L 2013/103; F01L 2820/032; F02D 13/0215; F02D 13/0219

USPC ..... 123/90.15, 90.17, 90.24, 90.25, 90.27

See application file for complete search history.

(56) References Cited

U.S. PATENT DOCUMENTS

2005/0193970 A1 9/2005 Moriya
2014/0245978 A1* 9/2014 Tadokoro ..... F01L 1/344 123/90.11

FOREIGN PATENT DOCUMENTS

JP 2017-075539 4/2017

* cited by examiner

*Primary Examiner* — Jorge L Leon, Jr.
(74) *Attorney, Agent, or Firm* — Nixon & Vanderhye P.C.

(57) ABSTRACT

A valve timing adjusting device adjusts an opening/closing timing of a first valve driven by a rotation of a first camshaft and an opening/closing timing of a second valve driven by a rotation of a second camshaft. The valve timing adjusting device includes a first driving circuit controlling a first motor configured to generate a torque to shift a rotation phase of the first camshaft and a second driving circuit controlling a second motor configured to generate a torque to shift a rotation phase of the second camshaft. A first switching element of the first driving circuit operates at a switching frequency that is different from that of a second switching element of the second driving circuit.

4 Claims, 6 Drawing Sheets

VALVE TIMING ADJUSTING DEVICE

CROSS REFERENCE TO RELATED APPLICATION

The present application is a continuation application of International Patent Application No. PCT/JP2020/019425 filed on May 15, 2020, which designated the U.S. and claims the benefit of priority from Japanese Patent Application No. 2019-095014 filed on May 21, 2019. The entire disclosures of all of the above applications are incorporated herein by reference.

TECHNICAL FIELD

The present disclosure relates to a valve timing adjusting device.

BACKGROUND

In an internal combustion engine, opening/closing timings of an intake valve and an exhaust valve of each of cylinders are adjusted by controlling a rotation phase of a camshaft with a valve timing adjusting device.

SUMMARY

A valve timing adjusting device is configured to adjust an opening/closing timing of a first valve and an opening/closing timing of a second valve. The first valve and the second valve are driven by a rotation of a first camshaft and a rotation of a second camshaft, respectively. The valve timing adjusting device includes a first motor, a first driving circuit, a second motor, and a second driving circuit. The first motor is configured to generate a torque to shift a rotation phase of the first camshaft. The first driving circuit is configured to control the first motor to adjust the rotation phase of the first camshaft. The first driving circuit includes a first switching element used for controlling the first motor. The second motor is configured to generate a torque to shift a rotation phase of the second camshaft. The second driving circuit is configured to control the second motor to adjust the rotation phase of the second camshaft. The second driving circuit includes a second switching element used for controlling the second motor. The first switching element operates at a switching frequency different from that of the second switching element.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

Figure 1:
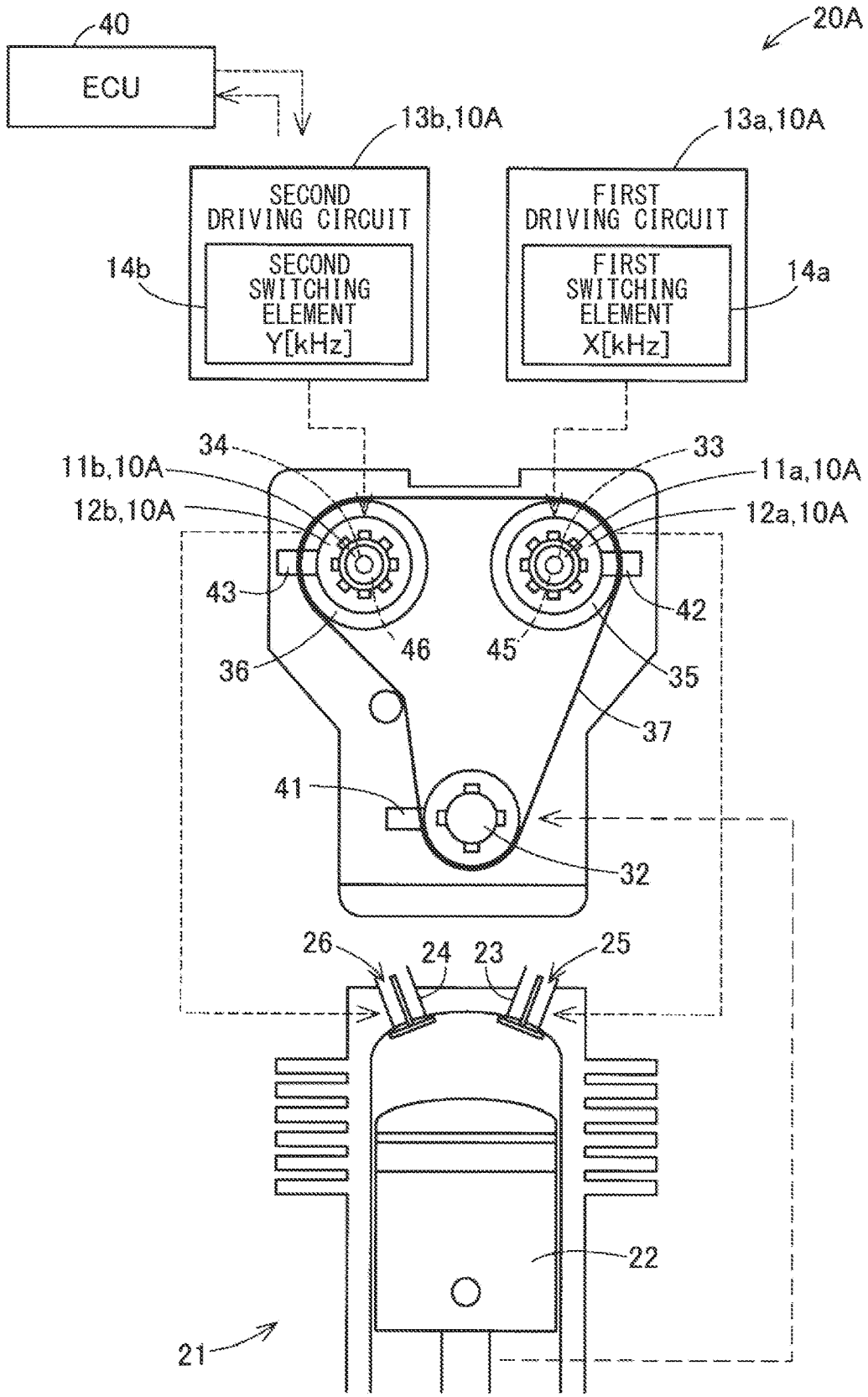
FIG. 1 is a schematic view of a configuration of an internal combustion engine including a valve timing adjusting device of a first embodiment.

To begin with, examples of relevant techniques will be described.

In an internal combustion engine, opening/closing timings of an intake valve and an exhaust valve of each of cylinders are adjusted by controlling a rotation phase of a camshaft with a valve timing adjusting device. For example, a valve timing adjusting device independently controls the rotation phase of the camshaft for the intake valve and the rotation phase of the camshaft for the exhaust valve.

The valve timing adjusting device usually includes a motor that generates a torque to shift the rotation phase of the camshaft and a driving circuit that controls the motor. In such a valve timing adjusting device, voltage and frequency of alternating current supplied to the motor are controlled by switching operation of a switching element of the driving circuit.

When the rotation phases of the multiple camshaft are controlled by using driving force of the multiple motors, the driving circuit as described above is provided for each of the motors. When such driving circuits are installed in one internal combustion engine, noises generated by the switching operation of the switching elements may be superimposed on the driving circuits. Such superimposed and increased noises may affect the internal combustion engine and other electronic devices installed around the internal combustion engine.

The technique of the present disclosure can be implemented as the following embodiments.

According to a first aspect of the present disclosure, a valve timing adjusting device is configured to adjust an opening/closing timing of a first valve and an opening/closing timing of a second valve. The first valve and the second valve are driven by a rotation of a first camshaft and a rotation of a second camshaft, respectively. The valve timing adjusting device includes a first motor, a first driving circuit, a second motor, and a second driving circuit. The first motor is configured to generate a torque to shift a rotation phase of the first camshaft. The first driving circuit is configured to control the first motor to adjust the rotation phase of the first camshaft. The first driving circuit includes a first switching element used for controlling the first motor. The second motor is configured to generate a torque to shift a rotation phase of the second camshaft. The second driving circuit is configured to control the second motor to adjust the rotation phase of the second camshaft. The second driving circuit includes a second switching element used for controlling the second motor. The first switching element operates at a switching frequency different from that of the second switching element.

According to the valve timing adjusting device of this mode, it is possible to prevent noises generated in each of the first switching element and the second switching element from being superimposed. Thus, it is possible to suppress influence of the noises on the internal combustion engine and other electronic devices installed around the internal combustion engine.

1. First Embodiment

Referring to FIG. 1, a valve timing adjusting device 10A of a first embodiment is mounted in an internal combustion engine 20A. The internal combustion engine 20A is mounted in, for example, a vehicle and generates a driving force of the vehicle. In the first embodiment, the internal combustion engine 20A is configured as a multi-cylinder inline engine and includes multiple cylinders 21. In another embodiment, the internal combustion engine may be configured as a single-cylinder engine including a single cylinder 21.

The cylinder 21 includes a piston 22 that reciprocates in a space below a combustion chamber of the cylinder 21, an intake port 23 that introduces fuel gas into the combustion chamber, and an exhaust port 24 that discharges exhaust gas from the combustion chamber. The intake port 23 includes an intake valve 25 that opens or closes the intake port 23 and the exhaust port 24 includes an exhaust valve 26 that opens or closes the exhaust port 24.

The internal combustion engine 20A further includes a crankshaft 32, an intake camshaft 33, an exhaust camshaft 34, and a timing chain 37 for each of the cylinders 21. The crankshaft 32 is an output shaft of the internal combustion engine 20A. The crankshaft 32 is connected to the piston 22 and rotates by reciprocating motion of the piston 22.

The intake camshaft 33 is connected to the intake valve 25 and configured to open and close the intake valve 25 according to a rotation phase of the intake camshaft 33. The exhaust camshaft 34 is connected to the exhaust valve 26 and configured to open and close the exhaust valve 26 according to a rotation phase of the exhaust camshaft 34. The intake camshaft 33 rotates a cam (not shown) attached to the intake camshaft 33 to drive a rocker arm (not shown) connected to a valve element of the intake valve 25, so that the intake valve 25 is opened or closed. The exhaust camshaft 34 rotates a cam (not shown) attached to the exhaust camshaft 34 to drive a rocker arm (not shown) connected to a valve element of the exhaust valve 26, so that the exhaust valve 26 is opened or closed.

In the internal combustion engine 20A, as will be described below, a rotation torque of the crankshaft 32 rotates the intake camshaft 33 and the exhaust camshaft 34 and opens or closes the intake valve 25 and the exhaust valve 26. A sprocket 35 is attached to the intake camshaft 33 and a sprocket 36 is attached to the exhaust camshaft 34. The crankshaft 32 is connected to the sprocket 35 of the intake camshaft 33 and the sprocket 36 of the exhaust camshaft 34 through a timing chain 37. As a result, the rotation torque of the crankshaft 32 is transmitted to the intake camshaft 33 and the exhaust camshaft 34 through the timing chain 37 and the sprockets 35 and 36, thereby rotating the intake camshaft 33 and the exhaust camshaft 34. In other embodiments, a timing belt may be used instead of the timing chain 37.

The valve timing adjusting device 10A adjusts an opening/closing timing of each of the intake valve 25 and the exhaust valve 26. The opening/closing timing of each of the intake valve 25 and the exhaust valve 26 can be rephrased as a valve timing of the internal combustion engine 20A. In the internal combustion engine 20A, the valve timing adjusting device 10A adjusts the rotation phase of the intake camshaft 33 relative to the crankshaft 32 and the rotation phase of the exhaust camshaft 34 relative to the crankshaft 32. As a result, the opening/closing timing of the intake valve 25 and the opening/closing timing of the exhaust valve 26 are separately adjusted. In the first embodiment, the intake valve 25 corresponds to a first valve and the intake camshaft 33 corresponds to a first camshaft. Further, the exhaust valve 26 corresponds to a second valve and the exhaust camshaft 34 corresponds to a second camshaft.

The valve timing adjusting device 10A includes, as a mechanism for adjusting the opening/closing timing of the intake valve 25, a first motor 11*a*, a first phase variable mechanism 12*a*, and a first driving circuit 13*a*. Further, the valve timing adjusting device 10A includes, as a mechanism for adjusting the opening/closing timing of the exhaust valve 26, a second motor 11*b*, a second phase variable mechanism 12*b*, and a second driving circuit 13*b*.

The first motor 11*a* is connected to the intake camshaft 33 through the first phase variable mechanism 12*a* and generates torque for shifting the rotation phase of the intake camshaft 33. The first phase variable mechanism 12*a* is composed of multiple gears (not shown) and shifts the rotation phase of the intake camshaft 33 with respect to the rotation phase of the crankshaft 32 according to a rotation speed of the first motor 11*a*. Specifically, the first phase variable mechanism 12*a* advances the rotation phase of the intake camshaft 33 when the rotation speed of the first motor 11*a* becomes higher than the rotation speed of the crankshaft 32. Further, the first phase variable mechanism 12*a* retards the rotation phase of the intake camshaft 33 when the rotation speed of the first motor 11*a* becomes lower than the rotation speed of the crankshaft 32, or a rotation direction of the first motor 11*a* is opposite to a rotation direction of the crankshaft 32. The first phase variable mechanism 12*a* causes the intake camshaft 33 to rotate along with the crankshaft 32 when the rotation speed of the first motor 11*a* is the same as the rotation speed of the crankshaft 32. Since the specific configuration of the first phase variable mechanism 12*a* is known, detailed description thereof will be omitted.

The first driving circuit 13*a* controls the first motor 11*a* in accordance with instructions from an ECU 40, which will be described later, and adjusts the rotation phase of the intake camshaft 33. The first driving circuit 13*a* includes a first switching element 14*a*. The first switching element 14*a* is composed of, for example, MOS FET. In the first embodiment, the first switching element 14*a* is incorporated in an inverter (not shown) included in the first driving circuit 13*a* and performs switching operation to control voltage and frequency of alternating current that is supplied to the first motor 11*a*. The first switching element 14*a* operates at a first switching frequency X. The first switching frequency X may be, for example, within a range of 10 kHz to 30 kHz.

The second motor 11*b* is connected to the exhaust camshaft 34 through the second phase variable mechanism 12*b* and generates torque for shifting the rotation phase of the exhaust camshaft 34. The second phase variable mechanism 12*b* has almost the same structure as the first phase variable mechanism 12*a* and shifts the rotation phase of the exhaust camshaft 34 with respect to the rotation phase of the crankshaft 32 according to a rotation speed of the second motor 11*b*.

The second driving circuit 13*b* controls the second motor 11*b* in accordance with instructions from the ECU 40, which will be described later, and adjusts the rotation phase of the exhaust camshaft 34. The configuration of the second driving circuit 13*b* is almost the same as the configuration of the first driving circuit 13*a* except that the second driving circuit 13*b* has a second switching element 14*b* instead of the first switching element 14*a*.

The second switching element 14*b* operates at a second switching frequency Y that is different from the first switching frequency X of the first switching element 14*a*. The second switching frequency Y may be, for example, within a range of 20 kHz to 40 kHz. In the first embodiment, the second switching frequency Y is set to a value higher than the first switching frequency X by about 5 to 15 kHz. In another embodiment, the second switching frequency Y may be set to a value lower than the first switching frequency X.

The drive of the internal combustion engine 20A is controlled by the ECU 40 (Electronic Control Unit). The ECU 40 is a microcontroller including a processor and a main storage device. The ECU 40 exerts various functions by executing instructions and programs read by the processor on the main storage device. The ECU 40 controls the driving circuits 13*a* and 13*b* of the valve timing adjusting device 10A to control the opening/closing timing of each of the intake valve 25 and the exhaust valve 26.

The ECU 40 uses the rotation phase of the crankshaft 32, the rotation phases of the intake camshaft 33 and the exhaust camshaft 34, and rotation angles of the first motor 11*a* and the second motor 11*b* for controlling the opening/closing timings. The rotation phase of the crankshaft 32 is detected by a crank angle sensor 41 provided on the crankshaft 32. Further, the rotation phases of the intake camshaft 33 and the exhaust camshaft 34 are detected by cam angle sensors 42 and 43 provided on the camshafts 33 and 34, respectively. The rotation angles of the first motor 11*a* and the second motor 11*b* are detected by motor rotation angle sensors 45 and 46 provided in the motors 11*a* and 11*b*, respectively.

In the valve timing adjusting device 10A of the first embodiment, as described above, the switching elements 14*a* and 14*b* included in the driving circuits 13*a* and 13*b* of the motors 11*a* and 11*b* operate at different switching frequencies. Thus, it is possible to suppress noises generated in the switching elements 14*a* and 14*b* from being superimposed and increasing. As a result, it is possible to suppress influence on an electronic device included in the internal combustion engine 20A and peripheral electronic devices. Therefore, the driving circuits 13*a* and 13*b* and other electronic devices can be arranged close to each other and the internal combustion engine 20A and the system including the internal combustion engine 20A can be downsized. In addition, it becomes possible to arrange a harness in a mode which is previously avoided due to the influence of the noises, thereby increasing the degree of freedom in designing the internal combustion engine 20A. In addition, according to the valve timing adjusting device 10A of the first embodiment, the opening/closing timing of the intake valve 25 and the opening/closing timing of the exhaust valve 26 can be controlled separately, so that the drive of the internal combustion engine 20A can be controlled in more detail.

2. Second Embodiment

Figure 2:
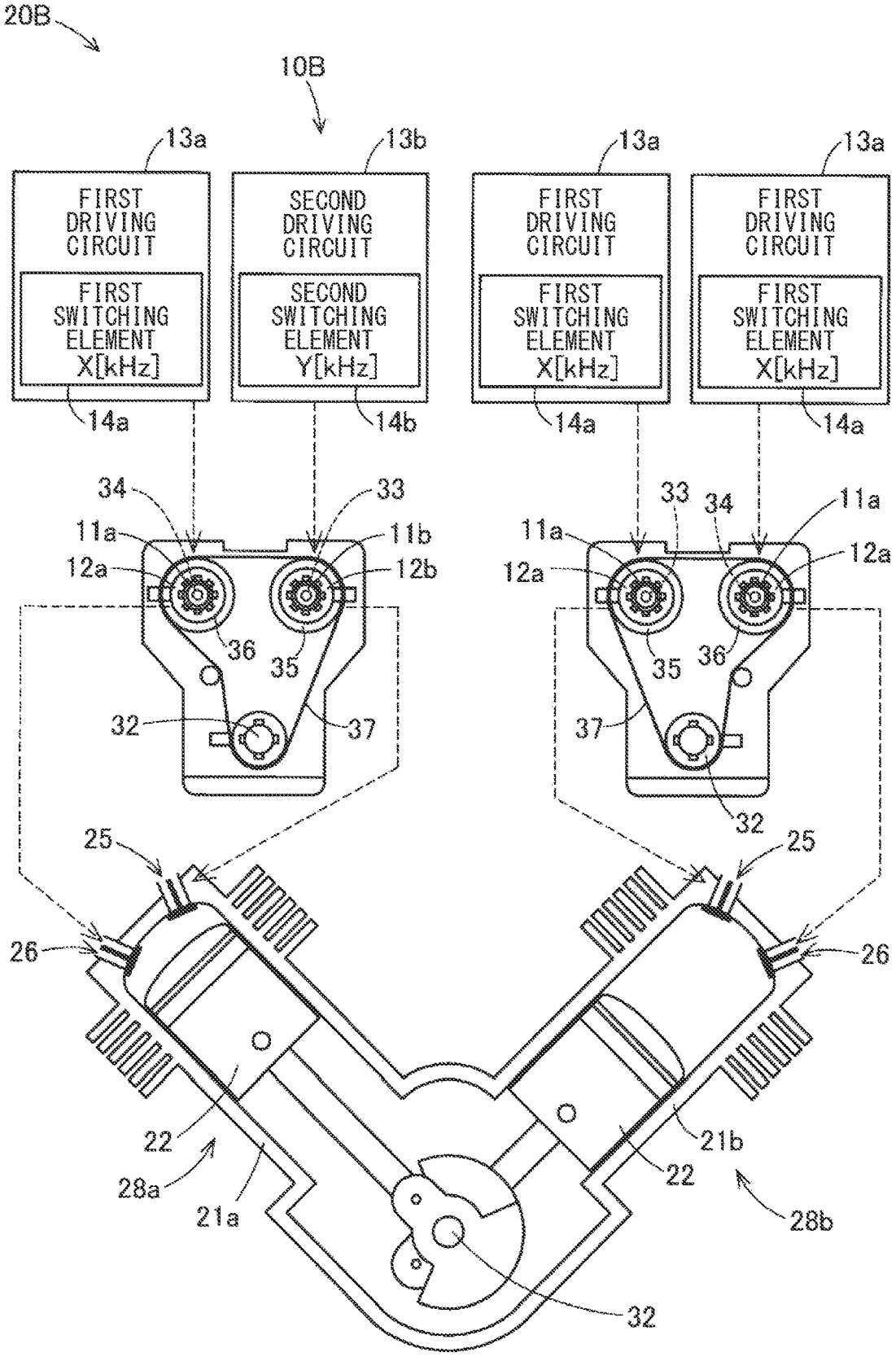
FIG. 2 is a schematic view of a configuration of an internal combustion engine including a valve timing adjusting device of a second embodiment.

Referring to FIG. 2, a valve timing adjusting device 10B of a second embodiment is mounted on an internal combustion engine 20B. In the second embodiment, the internal combustion engine 20B is configured as a V engine. A bank angle of the internal combustion engine 20B is not particularly limited. The internal combustion engine 20B may be configured as a narrow-angle V engine or a 180-degree angle V engine. The internal combustion engine 20B has a first cylinder 21*a* included in a first bank 28*a*, which is a left bank, and a second cylinder 21*b* included in a second bank 28*b*, which is a right bank. In the second embodiment, the internal combustion engine 20B has a configuration in which the intake valve 25 is arranged in an inner portion of the bank and the exhaust valve 26 is arranged in an outer portion of the bank. In the internal combustion engine 20B, the intake valve 25 may be arranged in the outer portion of the bank, and the exhaust valve 26 may be arranged in the inner portion of the bank. The internal combustion engine 20B is driven and controlled by the ECU 40, which is not shown in FIG. 2 for convenience, like the internal combustion engine 20A described in the first embodiment.

The valve timing adjusting device 10B of the second embodiment separately adjusts the opening/closing timings of the two valves 25 and 26 in the first bank 28*a* and the two valves 25 and 26 in the second bank 28*b*. The valve timing adjusting device 10B includes, as a mechanism for adjusting the opening/closing timings of three of the valves, multiple first motors 11*a*, multiple first phase variable mechanisms 12*a*, and multiple first driving circuits 13*a*. Further, the valve timing adjusting device 10B includes, as a mechanism for adjusting the opening/closing timing of the other one valve, a second motor 11*b*, a second phase variable mechanism 12*b*, and a second driving circuit 13*b*. The configurations of the motors 11*a* and 11*b*, the phase variable mechanisms 12*a* and 12*b*, and the driving circuits 13*a* and 13*b* are the same as those described in the first embodiment.

In the valve timing adjusting device 10B, the first motors 11*a* that are driven and controlled by the first driving circuits 13*a* and the first phase variable mechanisms 12*a* are connected to the exhaust camshaft 34 of the first cylinder 21*a*, the intake camshaft 33 of the second cylinder 21*b*, and the exhaust camshaft 34 of the second cylinder 21*b*. Further, the second motor 11*b* that is driven and controlled by the second driving circuit 13*b* and the second phase variable mechanism 12*b* are connected to the intake camshaft 33 of the first cylinder 21*a*. In the second embodiment, the exhaust valve 26 in the first cylinder 21*a* and the exhaust camshaft 34 correspond to the first valve and the first camshaft, respectively. Further, the intake valve 25 in the first cylinder 21*a* and the intake camshaft 33 correspond to the second valve and the second camshaft, respectively.

As described above, according to the valve timing adjusting device 10B, one of the switching elements 14*a* and 14*b* of the four driving circuits 13*a* and 13*b* for driving the four motors 11*a* and 11*b* operates at a different switching frequency. As a result, noises of all of the switching elements 14*a* and 14*b* are suppressed from being superimposed. In addition, according to the valve timing adjusting device 10B of the second embodiment, various effects similar to those described in the first embodiment can be obtained.

3. Third Embodiment

Figure 3:
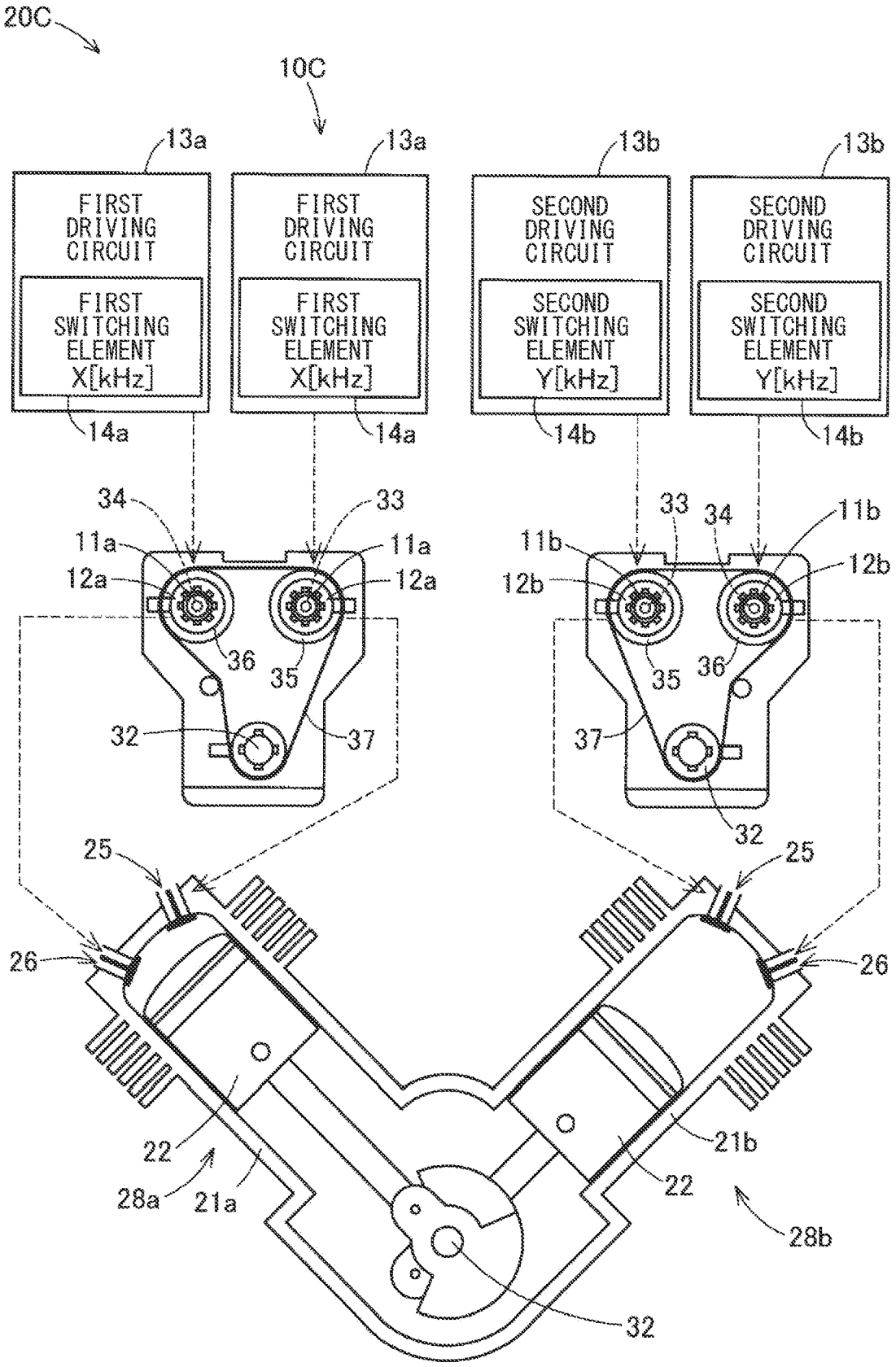
FIG. 3 is a schematic view of a configuration of an internal combustion engine including a valve timing adjusting device of a third embodiment.

Referring to FIG. 3, a valve timing adjusting device 10C of a third embodiment is mounted on an internal combustion engine 20C. In the third embodiment, the internal combustion engine 20C is configured as a V engine similar to that described in the second embodiment. The configuration of the valve timing adjusting device 10C of the third embodiment is almost the same as the configuration of the valve timing adjusting device 10B of the second embodiment except for points described below.

In the valve timing adjusting device 10C, the first motors 11*a* that are driven and controlled by the first driving circuits 13*a* and the first phase variable mechanisms 12*a* are connected to the intake camshaft 33 for the first bank 28*a* and the exhaust camshaft 34 for the first bank 28*a*. Further, the second motors 11*b* that are driven and controlled by the second driving circuits 13*b* and the second phase variable mechanisms 12*b* are connected to the intake camshaft 33 for the second bank 28*b* and the exhaust camshaft 34 for the second bank 28*b*. In the third embodiment, each of the valves 25 and 26 included in the first bank 28*a* corresponds to the first valve and each of the camshafts 33 and 34 included in the first bank 28*a* corresponds to the first camshaft. Further, each of the valves 25 and 26 included in the second bank 28*b* corresponds to the second valve and each of the camshafts 33 and 34 included in the second bank 28*b* corresponds to the second camshaft.

According to the valve timing adjusting device 10C of the third embodiment, switching elements 14*a* and 14*b* operating at different switching frequencies are applied to the first bank 28*a* and the second bank 28*b*. As a result, noises of the switching elements 14*a* and 14*b* are restricted from being superimposed between the bank 28*a* and the bank 28*b*. In addition, according to the valve timing adjusting device 10C of the third embodiment, various effects similar to those described in the above-described embodiments can be obtained.

4. Fourth Embodiment

Figure 4:
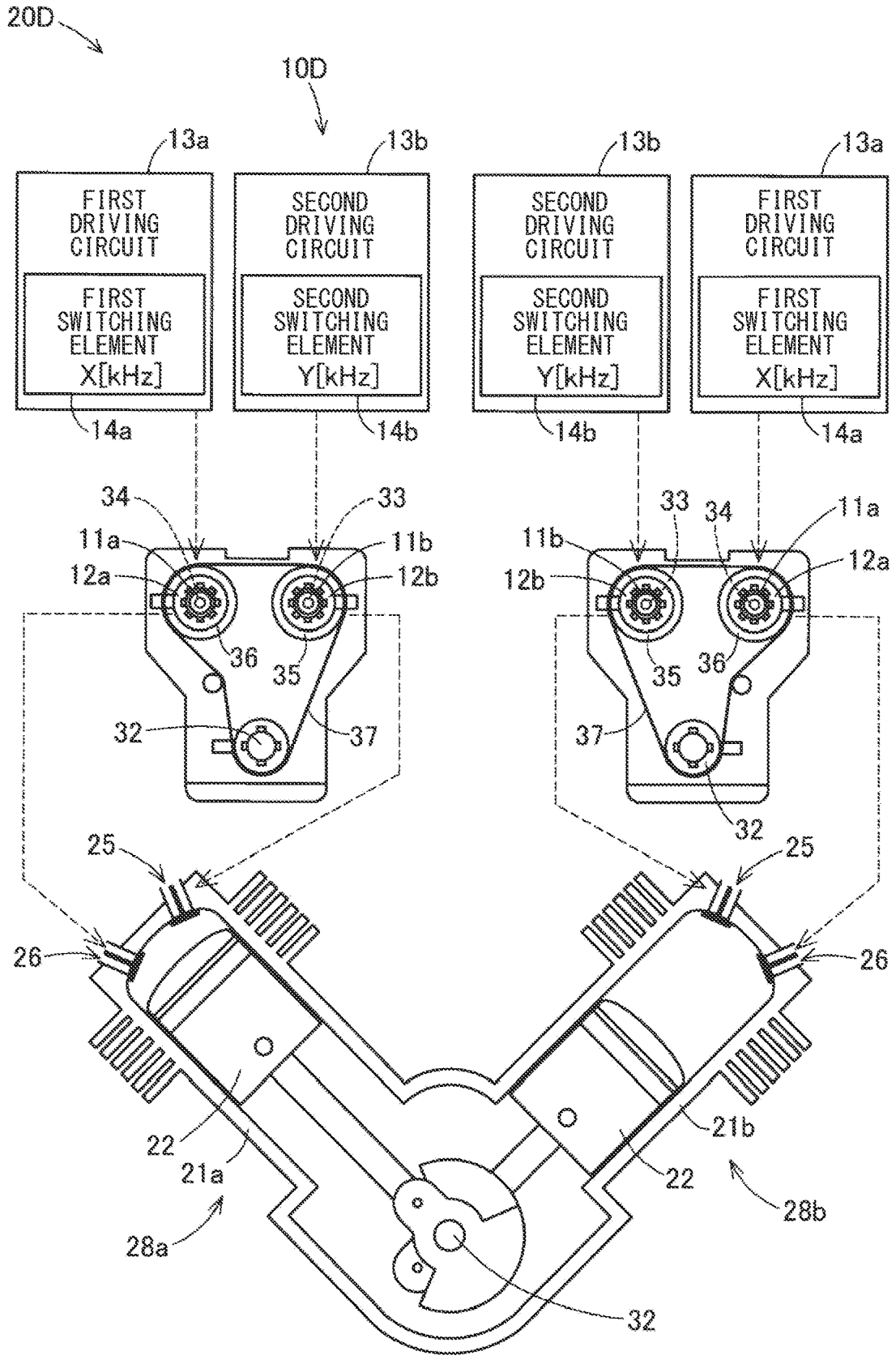
FIG. 4 is a schematic view of a configuration of an internal combustion engine including a valve timing adjusting device of a fourth embodiment.

Referring to FIG. 4, a valve timing adjusting device 10D of a fourth embodiment is mounted on an internal combustion engine 20D. In the fourth embodiment, the internal combustion engine 20D is configured as a V engine similar to that described in the third embodiment. The configuration of the valve timing adjusting device 10D of the fourth embodiment is almost the same as the configuration of the valve timing adjusting device 10C of the third embodiment except for points described below.

In the valve timing adjusting device 10D, the first motors 11*a* that are driven and controlled by the first driving circuits 13*a* and the first phase variable mechanisms 12*a* are connected to the exhaust camshaft 34 for the first bank 28*a* and the exhaust camshaft 34 for the second bank 28*b*. Further, the second motors 11*b* that are driven and controlled by the second driving circuits 13*b* and the second phase variable mechanisms 12*b* are connected to the intake camshaft 33 for the first bank 28*a* and the intake camshaft 33 for the second bank 28*b*.

According to the valve timing adjusting device 10D of the fourth embodiment, the switching elements 14*a* and 14*b* operating at different switching frequencies are applied to the adjusting mechanism for the opening/closing timings of the intake valves 25 and the exhaust valves 26 in the banks 28*a* and 28*b*. As a result, the noises of the switching elements 14*a* and 14*b* are restricted from being superimposed in each of the banks 28*a* and 28*b*. In addition, according to the valve timing adjusting device 10D of the fourth embodiment, various effects similar to those described in the above-described embodiments can be obtained.

5. Fifth Embodiment

Figure 5:
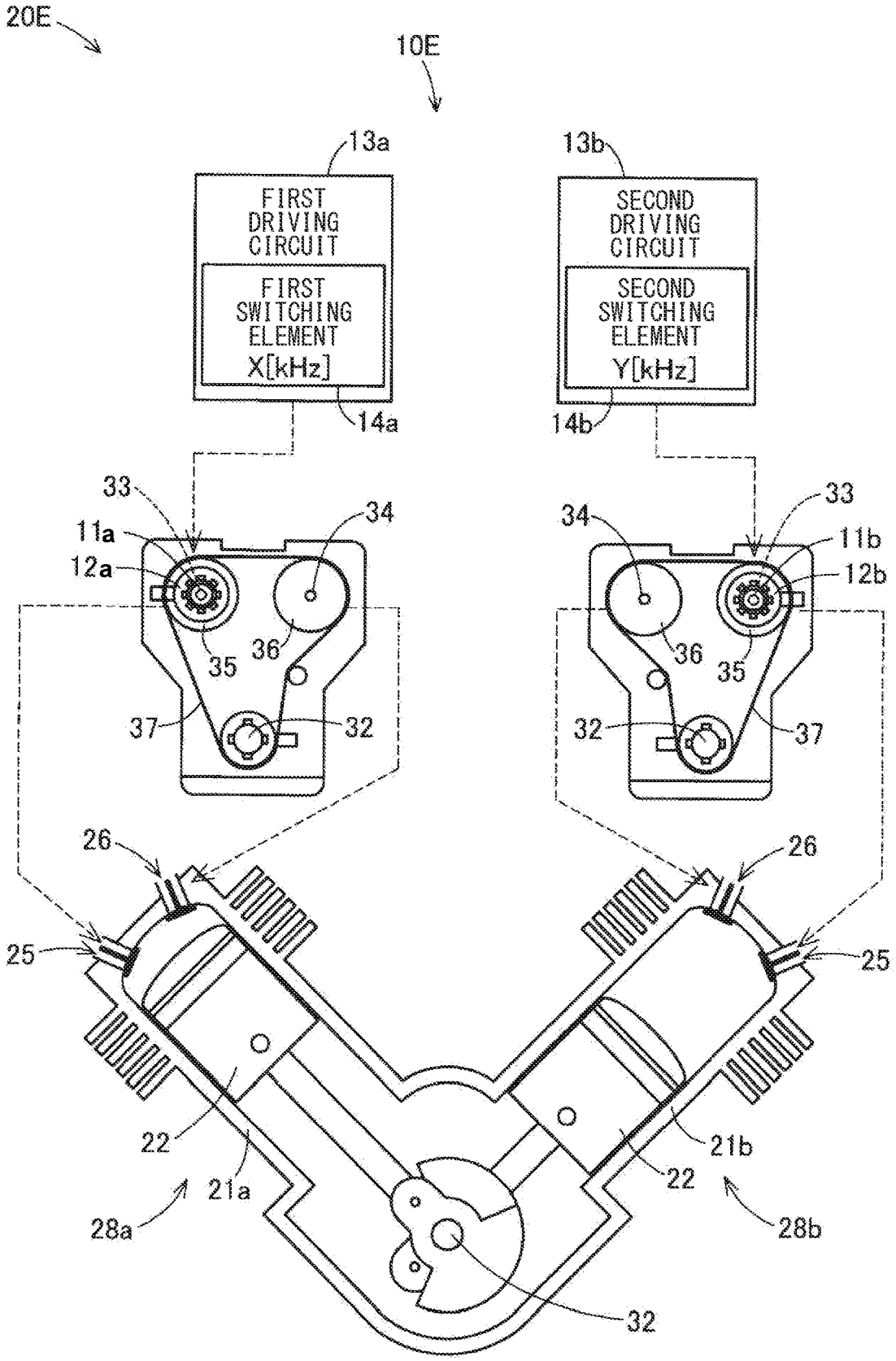
FIG. 5 is a schematic view of a configuration of an internal combustion engine including a valve timing adjusting device of a fifth embodiment.

Referring to FIG. 5, a valve timing adjusting device 10E of a fifth embodiment is mounted on an internal combustion engine 20E. In the fifth embodiment, the internal combustion engine 20E is configured as a V engine similar to that described in the fourth embodiment. The exhaust valve 26 is arranged in an inner portion of each of the banks and the intake valve 25 is arranged in an outer portion of each of the banks. The configuration of the valve timing adjusting device 10E of the fifth embodiment is substantially the same as the configuration of the valve timing adjusting device 10D of the fourth embodiment except for the points described below.

The valve timing adjusting device 10E adjusts the opening/closing timing of the intake valve 25 in the first cylinder 21*a* included in the first bank 28*a* and the intake valve 25 in the second cylinder 21*b* included in the second bank 28*b*. In the valve timing adjusting device 10E, the first motor 11*a* that is driven and controlled by the first driving circuit 13*a* and the first phase variable mechanism 12*a* are connected to the intake camshaft 33 of the first bank 28*a*. Further, the second motor 11*b* that is driven and controlled by the second driving circuit 13*b* and the second phase variable mechanism 12*b* are connected to the intake camshaft 33 of the second bank 28*b*.

According to the valve timing adjusting device 10E of the fifth embodiment, the switching elements 14*a* and 14*b* operating at different switching frequencies are used for the mechanism of adjusting the opening/closing timing of the intake valve 25 in each of the first bank 28*a* and the second bank 28*b*. As a result, noises of the switching elements 14*a* and 14*b* are restricted from being superimposed between the banks 28*a* and 28*b*. In addition, according to the valve timing adjusting device 10E of the fifth embodiment, various effects similar to those described in the above-described embodiments can be obtained.

6. Sixth Embodiment

Figure 6:
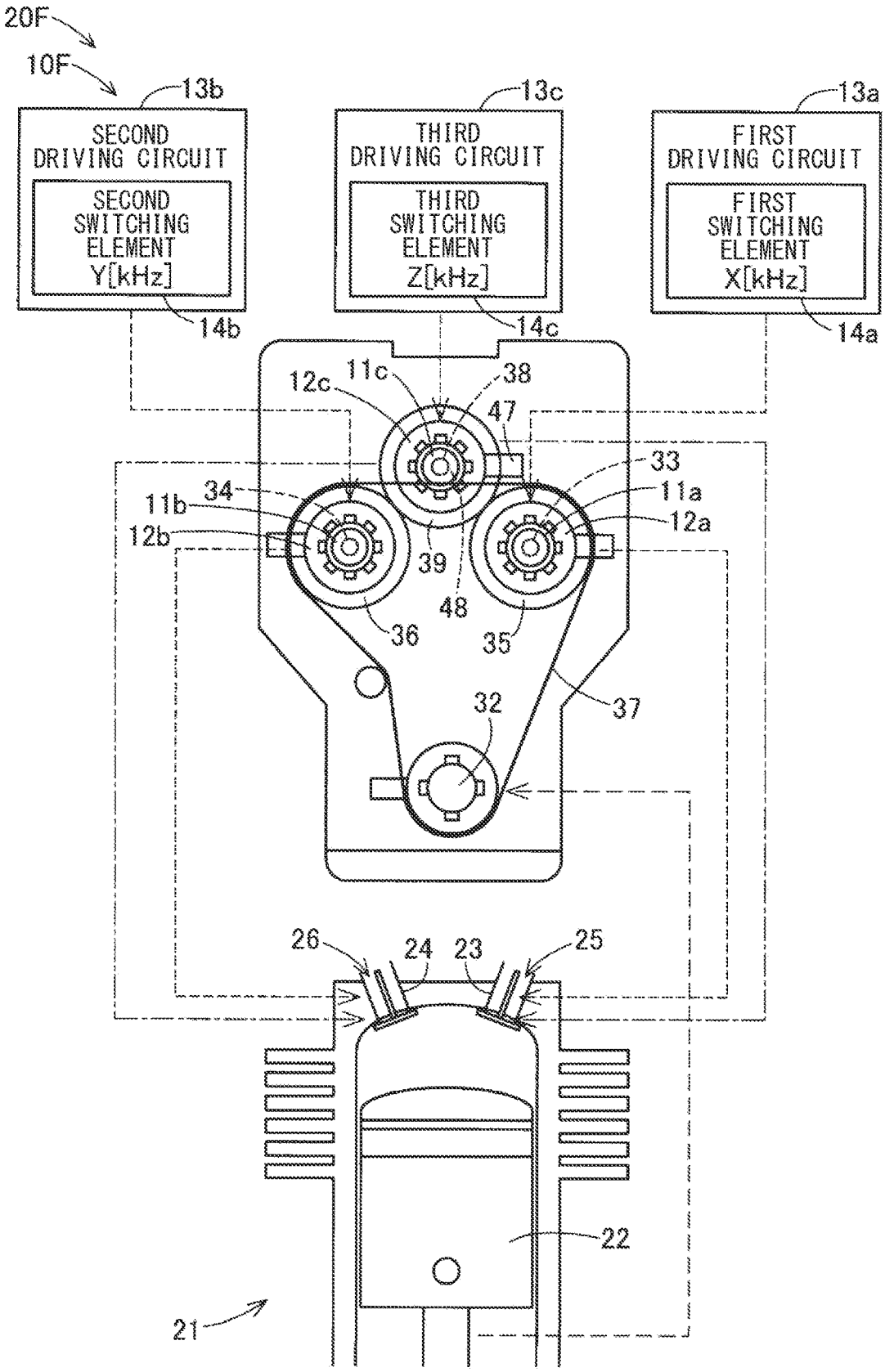
FIG. 6 is a schematic view of a configuration of an internal combustion engine including a valve timing adjusting device of a sixth embodiment.

Referring to FIG. 6, a valve timing adjusting device 10F of a sixth embodiment is mounted on an internal combustion engine 20F. In the sixth embodiment, the internal combustion engine 20F has a configuration in which a third camshaft 38 is added to the internal combustion engine 20A of the first embodiment. In the sixth embodiment, the intake camshaft 33 is referred to as a "first camshaft 33", and the exhaust camshaft 34 is referred to as a "second camshaft 34". The third camshaft 38 is connected to the sprocket 35 of the first camshaft 33 and the sprocket 36 of the second camshaft 34 via a sprocket 39, and rotates together with the first camshaft 33 and the second camshaft 34. In the internal combustion engine 20F, the rotation of the first camshaft 33 opens the intake valve 25, and the rotation of the second camshaft 34 opens the exhaust valve 26. Further, the rotation of the third camshaft 38 moves a rocker arm (not shown) and closes the intake valve 25 and the exhaust valve 26. The rotation phase of the third camshaft 38 is detected by a cam angle sensor 47 provided on the third camshaft 38.

The valve timing adjusting device 10F of the sixth embodiment adjusts the rotation phases of the three camshafts 33, 34, and 38 to adjust opening/closing timings of the intake valve 25 and the exhaust valve 26. The valve timing adjusting device 10F of the sixth embodiment has a configuration same as the valve timing adjusting device 10A of the first embodiment except that the valve timing adjusting device 10F further including a third motor 11*c*, a third phase variable mechanism 12*c*, and a third driving circuit 13*c*.

The third motor 11*c* is connected to the third camshaft 38 through the third phase variable mechanism 12*c* and generates torque that shifts the rotation phase of the third camshaft 38. The rotation angle of the third motor 11*c* is detected by a motor rotation angle sensor 48 provided in the third motor 11*c*. The third phase variable mechanism 12*c* has substantially the same configuration as the other phase variable mechanisms 12*a* and 12*b*, and shifts the rotation phase of the third camshaft 38 with respect to the rotation phase of the crankshaft 32 according to the rotation speed of the third motor 11*c*, similar to the phase variable mechanisms 12*a* and 12*b*.

The third driving circuit 13*c* controls the third motor 11*c* according to instructions from the ECU 40 to adjust the rotation phase of the third camshaft 38. The configuration of the third driving circuit 13*c* is almost the same as the configuration of the first driving circuit 13*a* except that the third driving circuit 13*c* has a third switching element 14*c* instead of the first switching element 14*a*. The third switching element 14*c* operates at a third switching frequency Z, which is different from both the first switching frequency X and the second switching frequency Y. The third switching frequency Z may be within a range of 10 kHz to 40 kHz. In the sixth embodiment, the third switching frequency Z is set to a value greater than the two switching frequencies X and Y. In another embodiment, the third switching frequency Z may be set to a value less than the two switching frequencies X and Y, or set to a value between the two switching frequencies X and Y.

According to the valve timing adjusting device 10F of the sixth embodiment, the switching elements 14*a*, 14*b*, 14*c* operating at different switching frequencies are applied to the mechanism for adjusting the rotation phases of the three camshafts 33, 34, 38. As a result, it is possible to restrict noises of the three switching elements 14*a*, 14*b*, and 14*c* from being superimposed in the internal combustion engine 20F. Further, according to the valve timing adjusting device 10F of the sixth embodiment, the rotation phases of the three camshafts 33, 34, and 38 can be adjusted separately, so that the opening/closing timings of the intake valve 25 and the exhaust valve 26 can be adjusted in more detail. In addition, according to the valve timing adjusting device 10F of the sixth embodiment, various effects similar to those described in the above-described embodiments can be obtained.

7. Other Embodiments

The various configurations described in the above embodiments can be modified as follows. The various embodiments described below are intended to be exemplary implementations of the technology described in this disclosure, similar to the embodiments described above.

Other Embodiment 1

The configuration of the internal combustion engine to which the valve timing adjusting devices 10A, 10B, 100, 10D, 10E, and 10F of the above embodiments are applied is not limited to the configurations described in the above embodiments. The internal combustion engine may be configured as, for example, a horizontally opposed engine other than the inline engine and the V engine. Further, the internal combustion engine equipped with the valve timing adjusting devices 10A, 10B, 10C, 10D, 10E, and 10F of the above embodiments may be applied to anything other than the vehicle.

Other Embodiment 2

In the above embodiments, the first switching element 14*a* and the second switching element 14*b* may be appropriately replaced with each other, or the configurations of the first bank 28*a* and the second bank 28*b* may be replaced with each other. In the fifth embodiment, a motor, a phase shift adjusting mechanism, and a motor driving circuit that adjust the rotation phase of the exhaust camshaft 34 may be added to either one of the first bank 28*a* or the second bank 28*b*. In the sixth embodiment, any one of the mechanisms for adjusting the rotation phases of the three camshafts 33, 34, 38 may be omitted.

8. Others

The techniques of the present disclosure are not limited to a valve timing adjustment device, and can be implemented in various forms. The techniques of the present disclosure can be realized, for example, in the form of an internal combustion engine including a valve timing adjusting device, a vehicle equipped with the internal combustion engine, and the like.

The technology of the present disclosure should not be limited to the embodiments described above or the modifications described above, and various other embodiments may be implemented without departing from the scope of the present disclosure. For example, the technical features in the embodiment corresponding to the technical features in the form described in the summary may be used to solve some or all of the above-described problems, or to provide one of the above-described effects. In order to achieve a part or all, replacement or combination can be appropriately performed. In addition, any technical features which are not explicitly described as being essential may be omitted where appropriate.

What is claimed is:

1. A valve timing adjusting device for adjusting an opening/closing timing of a first valve and an opening/closing timing of a second valve in an internal combustion engine, the first valve and the second valve being driven by a rotation of a first camshaft and a rotation of a second camshaft, respectively, the valve timing adjusting device comprising:

a first motor configured to generate a torque which adjusts a rotation phase of the first camshaft;

a first driving circuit configured to control the first motor via a first switch;

a second motor configured to generate a torque which adjusts a rotation phase of the second camshaft; and a second driving circuit configured to control the second motor via a second switch, wherein the first switch operates at a second switching frequency, and wherein the second operates at a second switching frequency different from the first switching frequency.

2. The valve timing adjusting device according to claim 1, wherein:

the first valve is an intake valve of the internal combustion engine, and the second valve is an exhaust valve of the internal combustion engine.

3. The valve timing adjusting device according to claim 1, wherein:

the internal combustion engine is configured as a V engine, the first valve is a valve in a first bank of the V engine, and the second valve is a valve in a second bank of the V engine.

4. The valve timing adjusting device according to claim 1, further comprising:

a third motor configured to generate a torque which adjusts a rotation phase of a third camshaft connected to the first valve and the second valve; and a third driving circuit configured to control the third motor via a third switch, wherein the third switch operates at a third switching frequency different from the first switching frequency and the second switching frequency.

* * * * *